US006783656B2

(12) United States Patent
De Nora et al.

(10) Patent No.: US 6,783,656 B2
(45) Date of Patent: Aug. 31, 2004

(54) LOW TEMPERATURE OPERATING CELL FOR THE ELECTROWINNING OF ALUMINIUM

(75) Inventors: Vittorio De Nora, Nassau (BS); Jean-Jacques Duruz, Geneva (CH)

(73) Assignee: MoltechInvent S.A. (LU)

( * ) Notice: Subject to any disclaimer, the term of this patent is extended or adjusted under 35 U.S.C. 154(b) by 0 days.

(21) Appl. No.: 10/133,198

(22) Filed: Apr. 27, 2002

(65) Prior Publication Data

US 2003/0010628 A1 Jan. 16, 2003

Related U.S. Application Data

(63) Continuation-in-part of application No. PCT/IB00/01481, filed on Oct. 16, 2000, which is a continuation-in-part of application No. PCT/IB99/01739, filed on Oct. 26, 1999.

(51) Int. Cl.[7] ..... C25C 3/08; C25C 3/12; C25C 3/06; C25C 3/00

(52) U.S. Cl. ..... 205/381; 205/380; 205/392; 205/396; 204/244; 204/245; 204/247; 204/293; 204/247.4

(58) Field of Search ..... 205/380, 381, 205/392, 396; 204/244, 245, 247, 293, 247.4

(56) References Cited

U.S. PATENT DOCUMENTS

| | | | | |
|---|---|---|---|---|
| 4,397,729 A | * | 8/1983 | Duruz et al. | 204/324.1 |
| 4,865,701 A | * | 9/1989 | Beck et al. | 204/241 X |
| 5,006,209 A | * | 4/1991 | Beck et al. | 204/243.1 X |
| 5,284,562 A | * | 2/1994 | Beck et al. | 204/243.1 |
| 5,560,809 A | * | 10/1996 | Cortellini | 204/243.1 |

* cited by examiner

*Primary Examiner*—Donald R. Valentine
(74) *Attorney, Agent, or Firm*—Jayadeep R. Deshmukh

(57) ABSTRACT

A cell for the electrowinning of aluminum using anodes (10) made from a alloy of iron with nickel and/or cobalt is arranged to produce aluminum of low contamination and of commercial high grade quality. The cell comprises a cathode (20) of drained configuration and operates at reduced temperature without formation of a crust or ledge of solidified electrolyte. The cell is thermally insulated using an insulating cover **(65,65*a*,65*b*,65*c*) and an insulating sidewall lining (71). The molten electrolyte (30) is substantially saturated with alumina, particularly on the electrochemically active anode surface, and with species of at least one major metal present at the surface of the nickel-iron alloy based anodes (10)**. The cell is preferably operated at reduced temperature from 730° to 910° C. to limit the solubility of these metal species and consequently the contamination of the product aluminum.

38 Claims, 4 Drawing Sheets

LOW TEMPERATURE OPERATING CELL FOR THE ELECTROWINNING OF ALUMINIUM

Continuation-in-part (CIP) of prior application No. PCT/IB00/01481, filed Oct. 16, 2000 which is a Continuation-in-part (CIP) of prior application No. PCT/IB99/01739, filed Oct. 26, 1999.

FIELD OF THE INVENTION

The invention relates to a cell for the electrowinning of aluminium from alumina dissolved in a crustless fluoride-containing molten electrolyte at a temperature below 910° C., as well as the production of aluminium in such cell.

BACKGROUND OF THE INVENTION

The production of aluminium today utilises cells for the electrolysis of alumina dissolved in cryolite with an excess of approximately 10 weight % aluminium fluoride, operating at a temperature of approximately 950° C., utilising carbon anodes.

Several patents have been filed and many granted concerning anode and cathode materials, shape, cell designs, operating conditions etc., and many solutions to specific problems have been proposed. However, no overall arrangement has heretofore been proposed which meets up to all the practical requirements for the industrial production of aluminium with low contamination.

The metal anodes suggested until now are highly soluble in the electrolyte utilised contaminating the aluminium produced, and have other drawbacks such as low electrical conductivity, short life and high cost.

All or some of these drawbacks can be eliminated by operating the cells at lower temperature which would require a high circulation of the electrolyte to maintain a sufficiently high concentration of alumina in the inter-electrode gap.

U.S. Pat. No. 4,681,671 (Duruz) proposed the production of aluminium by the electrolysis of alumina in a crustless fluoride-containing molten electrolyte at a temperature below 900° C. by effecting steady state electrolysis using an oxygen evolving anode but at a low anode current density. This led to the development of multimonopolar cell designs, described in U.S. Pat. No. 5,725,744 (de Nora/Duruz). Such designs are however not compatible with the use of cathodes made from carbon blocks protected with an aluminium-wettable slurry-applied coating of titanium diboride as described in U.S. Pat. No. 5,651,874 (de Nora/Sekhar).

Efforts have been made to achieve the advantages of low temperature electrolysis in cells with drained cathodes made of carbon blocks coated with an aluminium-wettable coating, but so far have not led to an accepted design meeting up to all requirements. WO 99/02764 (de Nora) and WO 99/02763 (de Nora/Sekhar) disclosed drained cells with oxygen evolving anodes, operating with a crustless electrolyte maintained by a thermal insulating cover. Electrolyte circulation was provided by sloping anodes and cathodes.

U.S. Pat. No. 5,983,914 (Dawless/LaCamera/Troup/Ray/Hosler) proposes to improve the dissolution of alumina in an electrolyte at 700° to 940° C. by using a sloping roof covering an array of vertical anodes and cathodes, the sloping roof intercepting and guiding anodically evolved oxygen.

OBJECTS OF THE INVENTION

One object of the invention is to provide an aluminium electrowinning cell incorporating nickel-iron alloy based anodes that can be operated without excessive contamination of the produced aluminium.

Another object of the invention is to provide an aluminium electrowinning cell operating with a crustless electrolyte, that can achieve high productivity, low contamination of the product aluminium, and whose components resist corrosion and wear.

Yet another object of the invention is to provide an aluminium electrowinning cell including nickel-iron alloy based anodes which remain substantially insoluble at the cell operating temperature.

An overall object of the invention is to provide a cell for the electrowinning of aluminium from alumina dissolved in a crustless fluoride-containing molten electrolyte, in particular at low temperatures, which overcomes the various drawbacks of the previous proposals.

SUMMARY OF THE INVENTION

The invention proposes a cell for the electrowinning of aluminium from alumina dissolved in a fluoride-containing molten electrolyte. The cell uses nickel-iron alloy based anodes for producing aluminium of low contamination and of commercial high grade quality. Each anode has an oxygen-evolving electrochemically active surface. The cell comprises a cathode having a drained cathode surface and operating at reduced temperature without formation of a crust or ledge of solidified electrolyte. The molten electrolyte is substantially saturated with alumina, particularly on the electrochemically active anode surface, and with species of at least one major metal present at the surface of the nickel-iron alloy based anodes.

A "major metal" refers to a metal which is present at the surface of the nickel-iron alloy based anode in an atomic and/or ionic form, in particular in one or more oxide compounds, in an amount of at least 25% of the total amount of metal atoms and/or ions present at the surface of the nickel-iron alloy based anode. Typically, such a metal can be iron, nickel or another major alloying metal of the nickel-iron alloy based anode, if such is present at the surface of the anode.

Usually, the operating temperature of an NaF—$AlF_3$ molten electrolyte is from 730° to 910° C. or from 780° to 880° C., in particular from 820° to 860° C., and preferably below 850° C. The concentration of alumina dissolved in the electrolyte is at most about 8 weight %, usually between 2 weight % and 6 weight %. The molten electrolyte may also contain $MgF_2$ and/or LiF in an amount of up to 5 weight % each. Further low temperature electrolytes are disclosed in U.S. Pat. No. 4,681,671 (Duruz).

For instance, a molten electrolyte containing about 3 weight % $Al_2O_3$ as well as NaF and $AlF_3$ in a weight ratio NaF/$AlF_3$ from about 0.71 to 0.81 is typically operated in the range of 780° and 860° C. at about 10° C. above its solidification temperature.

As described in patent application PCT/IB99/01976 (Duruz/de Nora), $AlF_3$ may be present in such a high concentration in the electrolyte that fluorine-containing ions rather than oxygen ions are oxidised on the electrochemically active surface, however only oxygen is evolved, the evolved oxygen being derived from the dissolved alumina present near the electrochemically active anode surfaces.

The drained cathode is preferably aluminium-wettable and may be associated with an aluminium collection channel along the cell for collecting produced molten aluminium draining from the drained cathode surfaces and leading into a central aluminium collection reservoir across the cell from where the produced molten aluminium can be evacuated from the cell. The drained cathode may comprise two inclined drained cathode surfaces arranged generally in a V-shape extending along the cell formed by upper surfaces of cathode blocks that extend across the cell, the cell being divided by the aluminium collection channel along the cell and by the central aluminium collection reservoir across the cell, the reservoir being formed by recessed spacer blocks spacing the cathode blocks.

Unlike in conventional cells where undissolved alumina collects as sludge on the cell bottom which prevents electrolysis from taking place, this configuration offers the advantage that any undissolved alumina can deposit on and flow together with the aluminium produced from the drained cathode surfaces into the collection recess from where it can be recovered, for instance when the product aluminium is tapped, without interfering with the normal course of electrolysis. A cell bottom design incorporating this feature is described in patent application PCT/IB99/00698 (de Nora), filed Apr. 16, 1999.

The cell has side walls contacted by the molten electrolyte and made of material resistant to the molten electrolyte including fused alumina, carbides and/or nitrides, such as silicon carbide, silicon nitride and boron nitride.

Preferably, the drained cathode surface on which aluminium is produced and from which the produced aluminium is drained comprises, or is associated with, inclined drained surfaces adjacent to the side walls. These inclined drained surfaces are inclined down towards the centre of the cell to keep the produced aluminium out of contact with the side walls.

Ledgeless and crustless cell operation may be achieved by means of a thermal insulation of the cell, including a sidewall insulation and an insulating cover above the molten electrolyte surface, sufficient to prevent the formation of any crust of solidified electrolyte or ledge of solidified electrolyte on the cell side walls. For example, the inside of the insulating cover can be held at a temperature differential as little as 10° C. below the temperature at the surface of the molten electrolyte. To allow for servicing of the anodes, the cover may be arranged to permit the removal and insertion of the anodes from/into the molten electrolyte. For this, it can include individually removable sections permitting removal of individual anodes or groups of anodes without adversely affecting the thermal balance, as disclosed in WO 99/02763 (de Nora/Sekhar).

The insulating cover may be of composite structure, having an inner surface layer of material resistant to fumes from the molten electrolyte, an insulating core and an outer support structure providing mechanical strength.

Optionally, the cell may comprise means for supplying heat, e.g. burners, between the insulating cover and the surface of the molten electrolyte to prevent cooling leading to the formation of an electrolyte crust when the insulating cover is removed.

The cell may comprise means for supplying powdered alumina between the thermal insulating cover and the molten electrolyte surface. The alumina supplying means may comprise a device for distributing preheated alumina by spraying or blowing it over the molten electrolyte surface.

Unlike the conventional point feeder devices used for cells with a frozen crust, these alumina supply means are arranged to distribute the supplied powdered alumina preferably over all of the molten electrolyte surface from where the alumina dissolves as it enters the electrolyte to maintain an even concentration of dissolved alumina in the circulating electrolyte. However, the supplied alumina may be distributed over selected areas of the molten electrolyte surface, usually making up a substantial part of the total surface. Such alumina distribution means, as described in patent application PCT/IB99/00968 (de Nora/Berclaz), filed Apr. 16, 1999, includes a device for spraying or blowing the alumina which is advantageously preheated.

The alumina to be sprayed or blown may be stored in a reservoir located above the cell and preheated. The heat evacuated from the cell with the gas produced during electrolysis and/or the heat conducted by stems feeding current to the active anode structures is optionally used to pre-heat the stored alumina. The alumina may alternatively or additionally be preheated while it is introduced into the cell above the molten electrolyte by blowing it with hot gas or a flame.

Means are provided for inducing electrolyte circulation generated by upward lift of oxygen released from the anodes, whereby the electrolyte circulates towards the molten electrolyte surface and down to the inter-electrode gap. These means can include sloped surfaces of the anodes facing sloping cathodes, or can include baffles, funnels or other electrolyte guide members with converging surfaces, arranged above a foraminate anode of open structure comprising a series of vertical through openings for the fast release of anodically produced oxygen and for the down flow of alumina-rich electrolyte into the anode-cathode gap for electrolysis, as described in patent application WO 00/40781 (de Nora), filed Jan. 8, 1999.

The means for inducing electrolyte circulation may comprise electrolyte guide members with converging surfaces. The guide members may be arranged above a foraminate anode of open structure comprising a series of vertical through openings for the rapid escape of anodically produced oxygen and for the down flow of alumina-rich electrolyte into the anode-cathode gap for electrolysis.

These means for inducing electrolyte circulation, together with the previously-described means for distributing alumina, result in enrichment of the electrolyte with dissolved alumina at a concentration which is close saturation even in the inter-electrode gap. The saturation of the electrolyte with alumina and its strong circulation limit the depletion of alumina and maintain a near-saturation concentration of dissolved alumina in the depleted electrolyte. As explained below, the presence in the electrolyte of alumina at a saturation concentration or close to saturation, together with dissolved metal species at or nearly at their saturation concentration which is reduced by the presence of alumina, inhibits dissolution of the nickel-iron alloy based anodes.

Usually, each electrochemically active anode surface comprises iron and nickel as metals and/or oxides. For example, the electrochemically active anode surface may comprise nickel ferrite. The electrochemically active anode surface may be an integral oxide based outer layer which can be obtained by oxidising the surface of a nickel-iron alloy body or layer, for example as disclosed in WO 00/06803 (Duruz/de Nora/Crottaz) and WO 00/06804 (Crottaz/Duruz). The electrolyte may contain dissolved iron and/or nickel species in an amount sufficient to inhibit dissolution of such an electrochemically active iron oxide and nickel oxide anode surface as described in WO 00/06802 and WO 00/06803 (Duruz/de Nora/Crottaz).

In one embodiment, the nickel-iron alloy anodes are surface oxidised in an oxidising atmosphere before use to produce an openly porous nickel metal rich outer portion which consists predominantly of nickel metal, as disclosed in PCT/IB99/01976 (Duruz/de Nora) and whose surface constitutes an electrochemically active anode surface of high surface area which in use is active for the oxidation of ions.

The open porosity can be produced before use by heat treatment in an oxidising atmosphere, e.g. at 1000°–1200° C. for 0.5–5 hours in air or another oxygen-containing atmosphere, which removes iron from the nickel-iron alloy by diffusion and oxidises the removed iron. Such a porosity contains cavities which are partly or completely filled before use with nickel and/or iron oxides and during use with fluorides of at least one metal selected from iron, nickel and aluminium. A similar porosity can be formed by electrolytic dissolution of part of the iron of the alloy's outer portion, which can be carried out by passing a current though the anode at low current density on the anode's surface, typically 1 to 100 mA/cm$^2$, in a fluoride-based electrolyte, for instance an electrolyte at a temperature below 870° C. and consisting essentially of cryolite with an excess of $AlF_3$ in an amount of about 25 to 35 weight % of the electrolyte, before use in an aluminium production cell or in-situ at start-up of the anode. Furthermore, these two methods of producing the porosity may be combined, e.g. partial conditioning of the anode by oxidation treatment can be completed by electrolytic dissolution.

An anode's electrochemically inactive surface which is exposed to molten electrolyte can be made of the same materials used for the electrochemically active anode surface or of other materials which are resistant to molten electrolyte.

The cell usually comprises means to adjust the positioning of the anodes over the drained cathode surface. These means may form part of an anode superstructure under which the anodes are suspended, the superstructure for example including one or more motors for small linear and/or angular displacements of the anodes and for fine adjustments of the inter-electrode distance. For instance, each anode is associated with an individual motor for linear displacements of the anode so the inter-electrode distance is adjustable for each anode separately in order to achieve a substantially uniform and equal current distribution between the cathode bottom and each anode and to prevent formation of local current peaks.

Alternatively, the anodes are positioned above the cathode bottom using electrically non-conductive spacer elements to ensure a constant inter-electrode distance. These spacer elements are made of a material resistant to the product aluminium, the molten electrolyte and the anodically produced oxygen, such as fused alumina, silicon carbide, silicon nitride or boron nitride, and may be embedded in the cathode bottom or mechanically secured to the anodes.

Each active anode structure can be made of a series of spaced apart parallel anode rods which are mechanically and electrically connected, usually with at least one connecting cross-member arranged transversally over the anode rods. This connecting member is preferably of variable section, i.e. decreasing from the middle of the active anode structure, where current is centrally fed from an anode stem, towards the extremities of the active anode structure, in order to feed current at a substantially uniform current density over the entire active anode structure.

Optionally, each anode is associated with means to oscillate it, for instance around at least one axis, to enhance distribution of dissolved alumina in the inter-electrode gap. At least one axis of oscillation can be substantially vertical to the drained cathode surface.

The product aluminium collected in the aforementioned central recess is of an acceptable purity due to the fact that the molten electrolyte contains dissolved metal species, corresponding to metal(s) of the nickel-iron alloy based anodes, in particular iron, at or nearly at a saturation concentration but which is reduced by the presence of dissolved alumina maintained in the circulating molten electrolyte and by the low temperature of the electrolyte. These combined effects inhibit dissolution of the nickel-iron alloy based anodes and lead to a concentration, in the produced molten aluminium, of the metals and/or metal species which are present as one or more corresponding metals and/or oxides at the electrochemically-active surface of the anodes, within commercially acceptable limits as explained in greater detail in patent applications WO 00/06802 and WO 00/06802 (both in the name of Duruz/de Nora/Crottaz).

In summary, the product aluminium has an acceptably low contamination due to the combined effect of operating with a low temperature molten electrolyte with improved electrolyte circulation and alumina distribution using nickel-iron alloy based anodes that are substantially insoluble in the electrolyte at the low operating temperature, and wherein the aluminium collection is separated from the side walls facilitating ledgeless operation.

A preferred embodiment of the invention combines several aspects of the cell described hereabove, as set out in claim 35.

Such a cell combines low temperature operation with crustless molten electrolyte with electrolyte circulation. The cell has an aluminium-wettable drained cathode and uses nickel-iron alloy based anodes which have low solubility. The cell has a single central aluminium collection channel and a central reservoir for collection of the produced molten aluminium which, thanks to the cell features and operating conditions, is of low contamination.

In contrast to the low-temperature cell disclosed in U.S. Pat. No. 4,681,671 (Duruz), the cell according to the invention can make use of a unipolar cathode made of an assembly of carbon cathode blocks protected with an aluminium-wettable protective coating. Moreover, whereas this US patent preferred an external circulation for enrichment of the molten electrolyte with alumina, the cell according to the invention achieves an internal circulation by means not suggested by the patent.

Compared to the drained cells with oxygen evolving anodes of WO 99/02764 (de Nora), the invention provides improved distribution of alumina and electrolyte circulation, in addition to lower contamination of the product aluminium and better protection of cell components, notably the side walls. Moreover, the invention is not limited to making use of inclined or vertical anode/cathode surfaces to produce the electrolyte circulation, neither is it limited to an inclined roof covering vertical anode and cathode packs as disclosed in U.S. Pat. No. 5,983,914 (Dawless/LaCamera/Troup/Ray/Hosler).

The invention thus provides an overall combination which has heretofore not been suggested and which leads to significant advantages.

In summary, the cell according to the invention combines a plurality or preferably most or all of the following features:

1) a molten electrolyte at reduced temperature, typically between 780° and 880° C., preferably between 820° and 860°, and in particular below 850° or 830° C.;
2) cathodes of drained configuration;
3) cathodes wetted by molten aluminium;

4) an electrolyte integrally in a molten state;

5) no formation of any ledge or crust of frozen electrolyte on the sidewalls, at the surface of the molten electrolyte or on the bottom of the cell;

6) nickel-iron based alloy containing anodes with an electrochemically active surface;

7) nickel-iron alloy based anodes having an electrochemically active surface comprising in particular iron and/or nickel species including oxides;

8) an electrolyte saturated or substantially saturated with the main element(s), in particular iron and/or nickel species, of the electrochemically active anode surfaces;

9) an insulating cover fitted over the cell and preventing the molten electrolyte from freezing;

10) active anode structures suspended with anode stems for feeding current, which stems are electrically highly conductive below the insulating cover;

11) a powder alumina dispersion system for uniform or substantially uniform alumina feeding over the molten electrolyte;

12) an alumina reservoir on top of the cell containing powdered alumina which is preheated using the heat generated by the cell;

13) gas burners below the insulating cell cover above the molten electrolyte, used to prevent electrolyte from freezing when the insulating cover or a section thereof is removed to insert or extract an anode or for another maintenance operation;

14) an electrolyte circulation induced by oxygen gas lift which is preferably controlled by deflectors arranged above the anode active structure;

15) each anode-cathode distance being individually settable to achieve a substantially uniform and equal current density and current distribution between the cathode bottom and each facing anode;

16) anode structures designed to feed electrical current at a substantially uniform current density to the active anode surface;

17) anode active surfaces prevented from contacting product aluminium during cell operation;

18) molten electrolyte substantially saturated with dissolved alumina, especially in the vicinity of the active anode surfaces;

19) active anode surfaces operating at a substantially uniform current density with no local current peaks;

20) molten electrolyte substantially saturated at the operating temperature with the main element of the electrochemically active anode surfaces and with dissolved alumina;

21) electrochemically inactive and active immersed surfaces of the anodes being all made of the same material; and 22) active anode surfaces sloped to permit rapid upward escape of anodically evolved gas facilitating electrolyte circulation.

Another aspect of the invention concerns a method of electrowinning aluminium in a cell for the electrowinning of aluminium by the electrolysis of alumina dissolved in a fluoride-based molten electrolyte as described above. The method comprises supplying alumina to the molten electrolyte where it is dissolved and electrolysing the dissolved alumina in the inter-electrode gap, to produce oxygen gas on the nickel-iron alloy based anodes and aluminium on the drained cathodes. Oxygen can be produced by oxidising oxygen-containing ions directly on the active surfaces or by firstly oxidising fluorine-containing ions that subsequently react with oxygen-containing ions, as described in PCT/IB99/01976 (Duruz/de Nora).

For instance, the electrolyte may contain $AlF_3$ in such a high concentration that fluorine ions rather than oxygen ions are oxidised on the electrochemically active anodes surfaces that are catalytically active for the oxidation of fluorine-containing ions rather than oxygen ions, however, only oxygen is evolved. The evolved oxygen is derived from the dissolved alumina present near the electrochemically active anode surfaces.

The oxidation of fluorine-containing ions rather than oxygen ions on the anode surface inhibits oxidation of the anode by oxidised oxygen ions, in particular monoatomic nascent oxygen, formed on the anode surface. Thus, oxygen is formed at a distance of the anode surface either by reaction of oxygen ions with oxidised fluorine containing ions or by decomposition of transient oxidised oxyfluoride ions.

The mechanism of oxidation of fluorine-containing ions rather than oxygen ions can be achieved by operating the cell with a nickel-iron anode having a openly porous nickel metal rich outer portion as electrochemically active surface as described above.

As nickel and cobalt behave very similarly under the above described cell conditions, in modifications of the above aspects of the invention, the nickel of the anodes is wholly or predominantly substituted by cobalt. For example, the anode is made from a nickel-cobalt-iron alloy or a cobalt-iron alloy.

BRIEF DESCRIPTION OF DRAWINGS

The invention will be further described with reference to the accompanying schematic drawings, in which.

GENERAL DESCRIPTION OF A SPECIFIC EMBODIMENT

Figure 1:
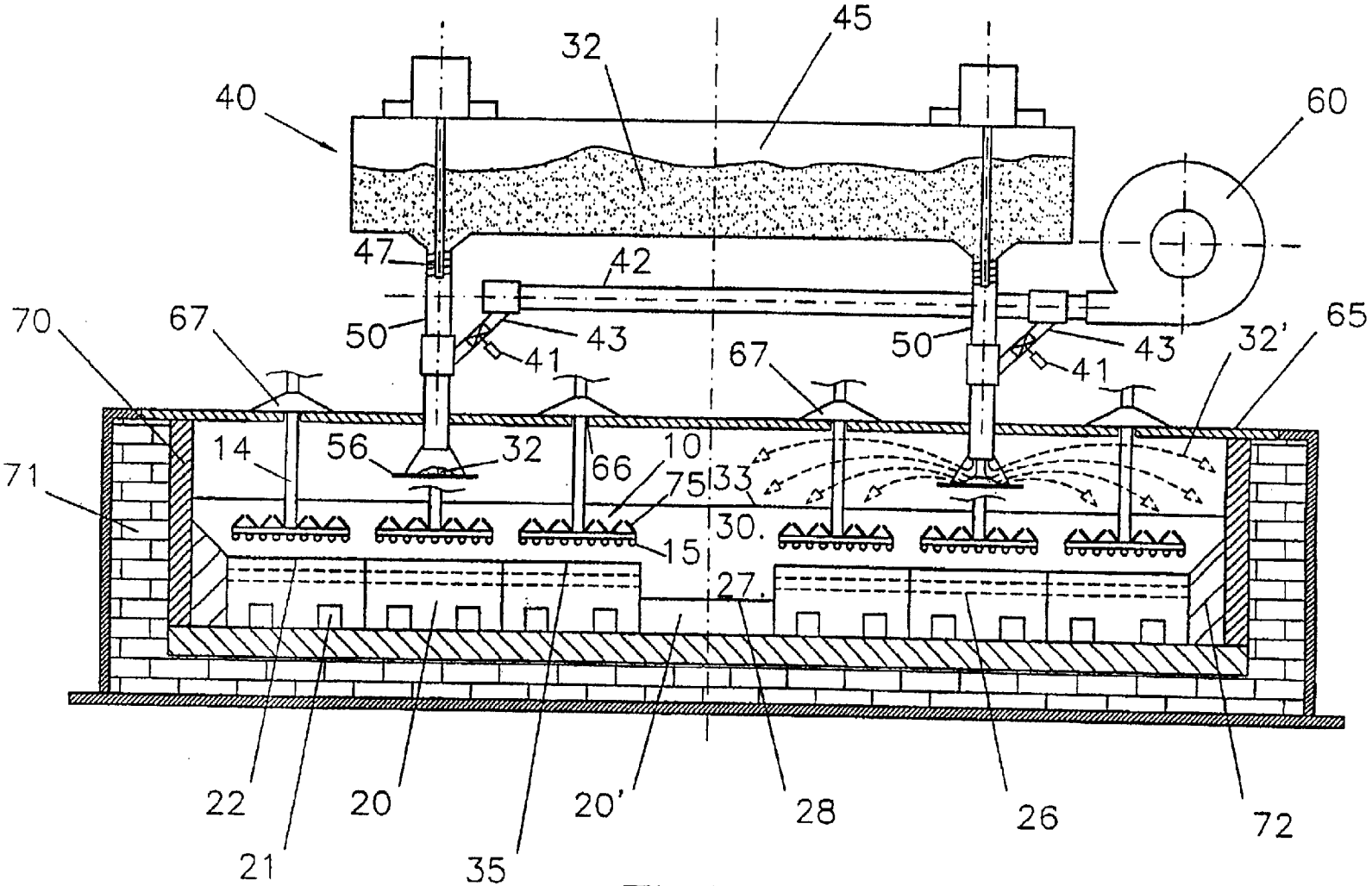
FIG. 1 shows a longitudinal section of a cell according to the invention, the anode superstructure being not shown.
Figure 2:
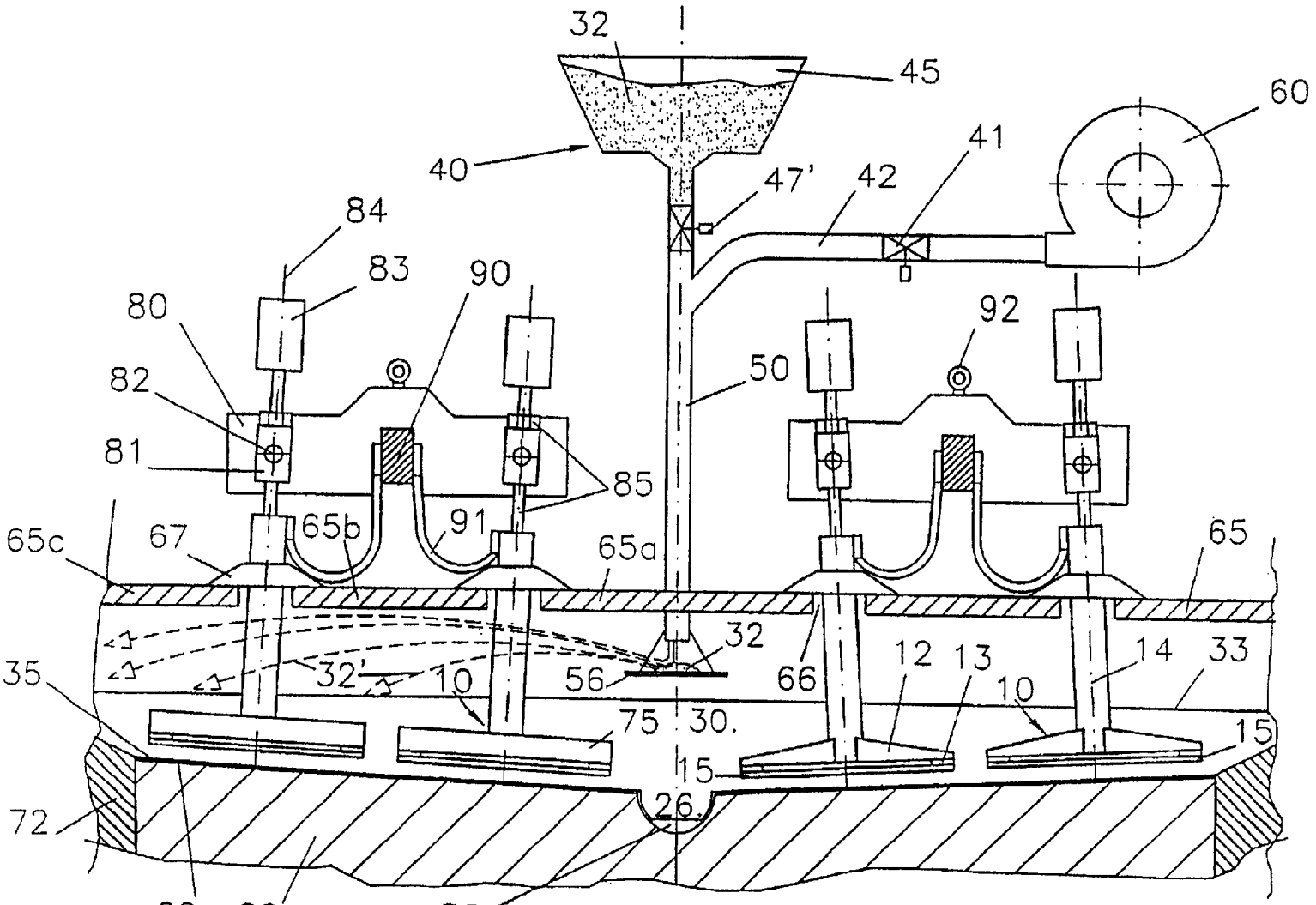
FIG. 2 is a cross-sectional view of part of the cell of FIG. 1 showing the anode superstructure and a modified anode/stem connection.
Figure 3:
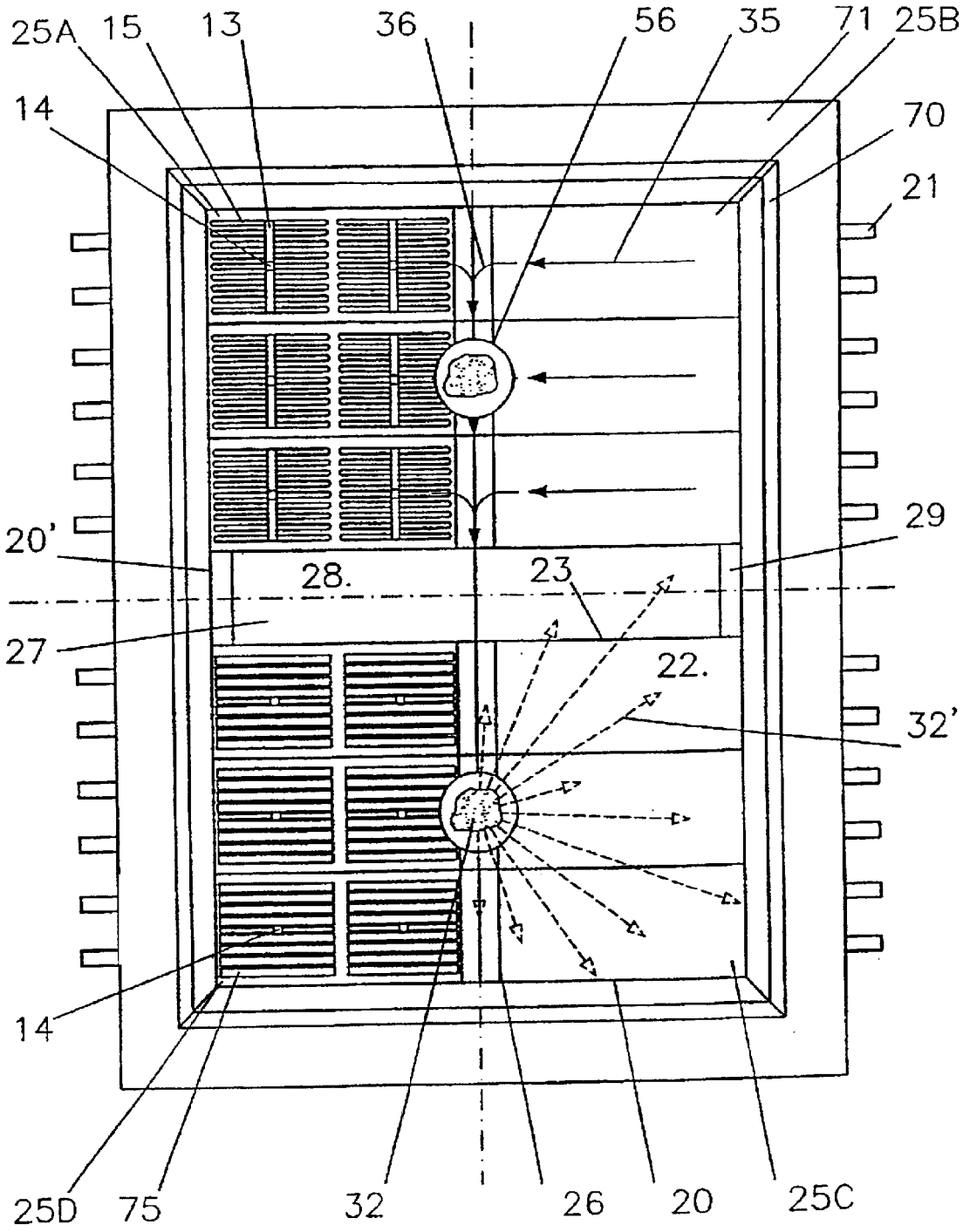
FIG. 3 is a plan view of the bottom of the cell shown in FIG. 1 with two alumina spreaders shown, the cell bottom being schematically divided into four quadrants illustrating different features.

The cell shown in FIGS. 1, 2 and 3 is provided with a series of anodes 10 facing a drained cathode surface 22 and is insulated with an insulating cover 65 and an insulating sidewall lining 71 permitting ledgeless and crustless operation of molten electrolyte 30 contained in the cell, the molten electrolyte being at a temperature from 730° to 910° C., for example from 780° to 880° C.

Figure 4:
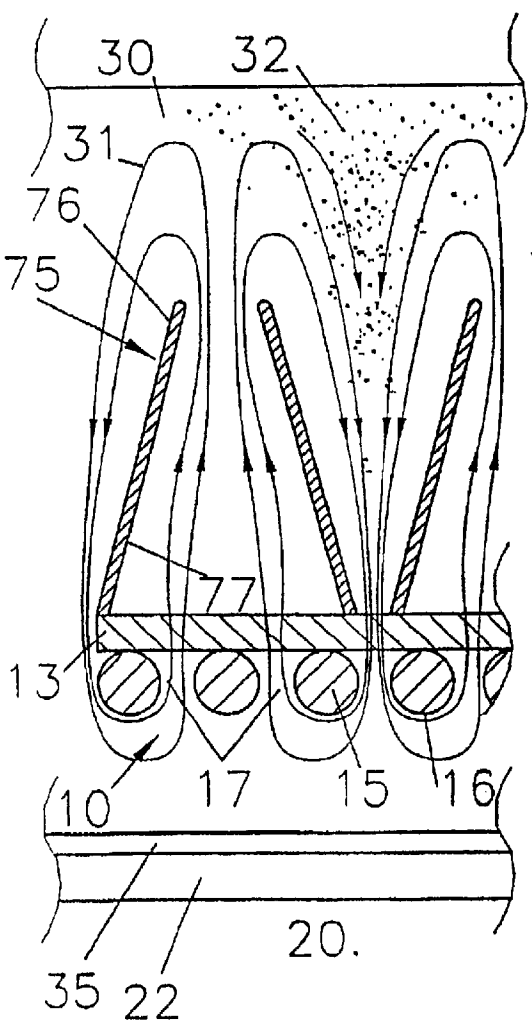
FIG. 4 is a detailed view of part of an anode structure with deflectors of FIG. 1, showing an electrolyte circulation during operation.

Each anode 10 carries a series of deflectors 75 for generating an electrolyte circulation 31, as shown in detail in FIG. 4. Alumina powder 32 is sprayed over the molten electrolyte surface 33 with an alumina spraying device 40 fitted over the cell cover 65, as shown in FIGS. 1 and 2.

Product aluminium 35,36 is drained from the cathode surface 22 first into an aluminium collection groove 26 and then into a central aluminium collection reservoir 27 from where the product aluminium can be tapped. The collection groove 26 and collection reservoir 27 divide the cathode surface 22 into four quadrants 25, shown schematically in FIG. 3 and which represent different features of the cell.

The first quadrant 25A (upper left corner of FIG. 3) is shown with six active anode structures 13,15. The second quadrant 25B (upper right corner) illustrates the draining of molten aluminium 35,36. The third quadrant 25C (lower right corner) illustrates the spraying of powder alumina 32'. The fourth quadrant 25D (lower left corner) is shown with six facing anode structures each carrying a series of deflectors 75.

Nickel-Iron Alloy Based Anodes

Figure 6:
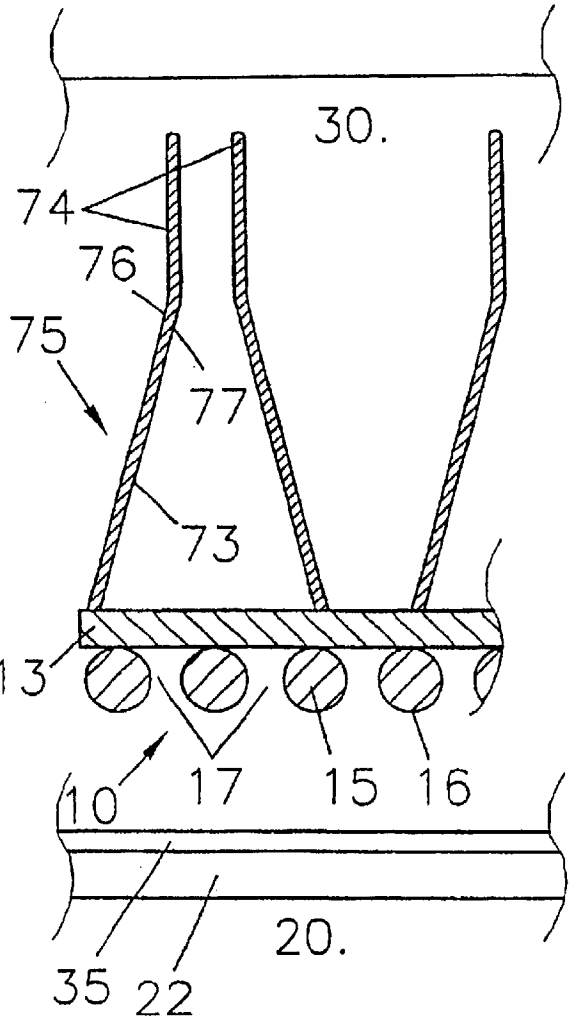
FIGS. 5 and 6 show variations of the deflectors shown in FIG. 4.
Figure 5:
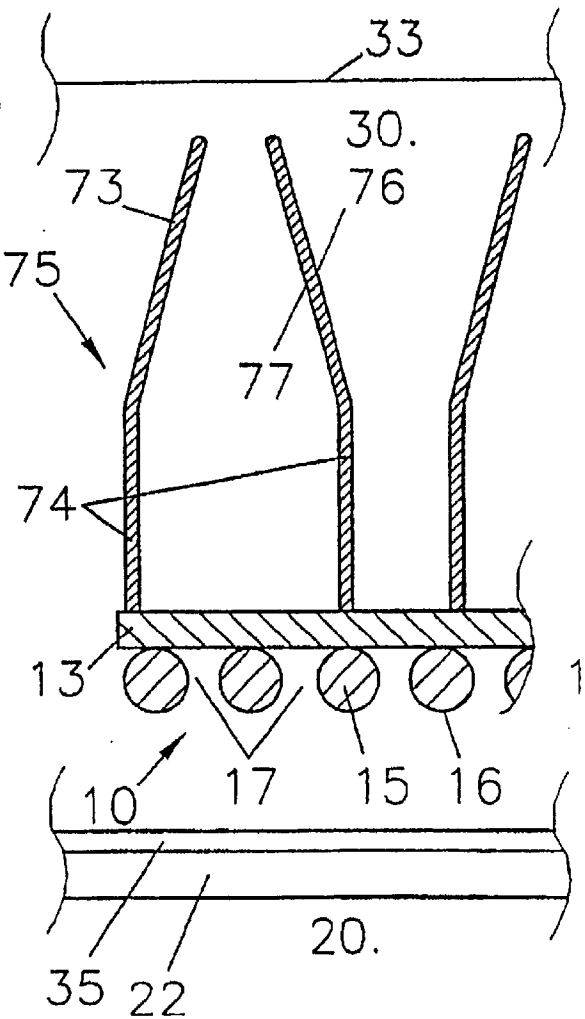

As shown generally in FIGS. 1 to 3 and in greater detail in FIGS. 4 to 6, the nickel-iron alloy based anodes 10 have oxygen-evolving active anode structures 13,15 made of surface oxidised nickel-iron alloy containing for example 60 weight % nickel and 40 weight % iron, as disclosed in WO 00/06804 (Crottaz/Duruz), or nickel-iron alloy anodes with an openly porous nickel metal rich outer portion, as described above. Each anode structure 13,15 comprises a series of rods 15 in a generally coplanar arrangement and spaced laterally by inter-rod gaps 17 for the up-flow of alumina-depleted electrolyte driven by the upward fast escape of anodically evolved oxygen, and for the down-flow of alumina-rich electrolyte, as shown in FIGS. 4 to 6. Each anode rod 15 is provided with an electrochemically active oxygen-evolving anode surface 16 facing the drained cathode surface 22.

FIGS. 4 to 6 show also a series of deflectors 75 located above the anode structures 13,15. The deflectors 75 which have downward and upward converging surfaces 76,77, such as alternately inclined baffles 75' for inducing an upward and downward electrolyte circulation 31 through the anode structure 13,15 driven by anodically produced gas.

In the left-hand side of FIG. 2, the anodes 10 are shown with the deflectors 75, whereas on the right-hand side of FIG. 2, the anodes 10 are shown for the purpose of illustration without deflectors. Similarly, in the left-hand side of FIG. 3 which shows the anodes 10 over the cell bottom, in the upper part of the FIG. 3 (first quadrant 25A), the anode structures 13,15 and the stems 14 are shown for the purpose of illustration without deflectors, whereas in the lower part of the Figure (fourth quadrant 25D) the anodes 10 are shown with deflectors 75.

Different shapes of deflectors 75 are shown in FIGS. 4 to 6. In FIG. 4, each deflector 75 consists of an inclined blade. In FIG. 5, the deflectors are made of longitudinally bent blades so disposed on the anode structure 13,15 as to have vertical lower parts 74 and inclined upper parts 73. In FIG. 6, the bent blades are positioned so that their upper parts 74 are vertical, while their lower parts 73 are inclined.

Such anode structures 13,15 and deflectors 75 may be designed as described in co-pending application WO 00/40781 (de Nora).

The anode rods 15 are mechanically connected by one or more transverse connecting members 13 which are in turn connected to an anode stem 14 suspending and feeding current to the anode structure 13, 15, as shown in FIG. 2. In the right-hand side of this Figure, the lower part of the anode stem 14 is provided with attachment members 12 which, for example, extend diagonally over the anode structure 13,15 for attaching the stem 14 to cross-members 13 located at one end of the anode structure 13,15.

Alternative anode structures 13,15 shown in FIG. 3 (first and fourth quadrant) have each a single connecting cross-member 13 located in the centre of the anode structure 13,15. The anode stem 14 is connected to this single cross-member 13, without any further attachment members.

Anode Positioning

As shown in FIG. 2, the anode structures 13,15 face and are spaced apart from an aluminium-wettable drained inclined cathode surface 22. Each anode 10 is held and positioned above the cathode surface 22 through its stem 14 by an anode superstructure 80 resting on a busbar 90 for feeding current to the anodes 10 via detachably connected flexible conductors 91.

Each anode superstructure 80 holds a pair of neighbouring anodes 10 and comprises two positioning arms 81 for positioning the anodes 10, each positioning arm 81 holding one anode 10. Each positioning arm 81 is associated with a first angular drive (not shown) arranged to pivot arm 81 about a horizontal axis 82, a second angular drive 83 arranged to pivot arm 81 about a longitudinal axis 84 which extends along arm 81 and anode stem 14, and a linear screw-operated drive 85 for linear displacements of the anode 10 along longitudinal axis 84.

The first angular drive can be controlled to position the anode structure 13,15 parallel to the cathode surface 22. The second angular drive 83 can be operated when needed to oscillate the anode structure 13,15 in its own plane about an angle of approximately 15–20°, to mix the molten electrolyte 30, in particular to enhance the distribution of dissolved alumina under the anode structure 13,15. It is recommended to operate synchronously all second angular drives 83 of all anodes 10 facing a same quadrant 25 of the cell, so as to prevent collision between anodes 10.

The linear drive 85 is used to control the inter-electrode distance between anode 10 and the cathode surface 22.

By means of such linear drives, each anode 10 may be individually positioned over the cathode surface 22 with the inter-electrode distance adjusted for each anode 10 separately, in order to achieve a substantially uniform and equal current distribution between the cathode surface 22 and each anode 10.

The anode superstructure 80 is provided with an attachment ring 92 which can be used to carry the superstructure, for instance using a pulley block secured on a gantry (not shown). When anodes 10 need to be introduced or extracted from the cell, e.g. for replacement or maintenance, the superstructure 80 with its pair of neighbouring anodes 10 is placed on or removed from the busbar 90, the busbar 90 remaining permanently fixed over the cell.

The Cell Bottom

The drained cathode surface 22 is formed by upper surfaces of a series of juxtaposed carbon cathode blocks 20 extending in pairs arranged end-to-end across the cell. Alternatively, the drained cathode surface may be made of upper surfaces of a series of juxtaposed cathode blocks extending individually across the cell. The cathode blocks 20 comprise, embedded in recesses located in their bottom surfaces, current supply bars 21 of steel or other conductive material for connection to an external electric current supply.

The cathode blocks 20 are preferably coated with an aluminium-wettable coating forming the drained cathode surface 22, such as a coating of an aluminium-wettable refractory hard metal (RHM) having little or no solubility in aluminium and having good resistance to attack by molten cryolite. Useful RHM include borides of titanium, zirconium, tantalum, chromium, nickel, cobalt, iron, niobium and/or vanadium. Useful cathode materials are carbonaceous materials such as anthracite or graphite.

A preferred drained cathode coating consists of particulate refractory hard metal boride in a colloid applied from a slurry of the particulate refractory hard metal boride in a colloid carrier, wherein the colloid comprises at least one of colloidal alumina, silica, yttria, ceria, thoria, zirconia, magnesia, lithia, monoaluminium phosphate or cerium acetate, as described in U.S. Pat. No. 5,651,874 (de Nora/Sekhar) or WO 98/17842 (Sekhar/Duruz/Liu). The colloidal carrier has been found to considerably improve the properties of the coating produced by non-reactive sintering. The wettability of the coating may be improved by adding a wetting agent consisting of at least one metal oxide, such as copper, iron or nickel oxide, that reacts during use with molten aluminium to produce aluminium oxide and the metal of the wetting oxide, as disclosed in PCT/IB99/01982 (de Nora/Duruz).

As shown in FIG. 3, the drained cathode surface 22 is divided into four separate quadrants 25 by an aluminium collection groove 26 along the cell and by a central aluminium collection reservoir 27 across the cell.

The aluminium collection groove 26 may be horizontal as shown in FIG. 1 or, alternatively, slightly sloping downwards towards the aluminium collection reservoir 27 to facilitate molten aluminium evacuation.

The aluminium collection reservoir 27 is formed by a central recess 28 in upper surfaces of a pair of spacer blocks 20' arranged end-to-end across the cell, the recess 28 being lower than the aluminium evacuation groove 26. Alternatively, the central recess 28 may also be formed in an upper surface of a single spacer block extending across the cell.

The spacer blocks 20' space apart and are juxtaposed between two pairs of cathode blocks 20, each pair being arranged end-to-end across the cell.

As shown in FIG. 3, the central recess 28 of the spacer blocks 20' extends between the juxtaposed cathode blocks 20 to form with non-recessed ends 29 of the spacer blocks 20' and with juxtaposed lateral cathode faces 23 of the juxtaposed cathode blocks 20 the aluminium collection reservoir 28.

The cathode surfaces 22 of pairs of cathodes 20 across the cell are inclined in a generally flattened V-shape, as shown in FIG. 2. The upper surface 22 of each cathode block 20 can be machined as a single ramp along the block 20 to provide a V configuration by arrangement with a corresponding cathode block 20 positioned end-to-end across the cell.

Similarly to the cathode blocks 20, the spacer blocks 20' can also be made by machining the upper surface of carbon blocks. However, in contrast to the cathode blocks 20, it is not necessary to connect the spacer blocks 20' to a negative current supply.

Also shown in FIGS. 2 and 3, the series of anodes 10 along the cell are arranged by pairs, each pair located on either side of the aluminium evacuation groove 26 above the drained cathode surface 22. Each pair of neighbouring anodes 10 is arranged across the cell on either side the evacuation groove 26, and with their active structure 13,15 parallel to the corresponding facing ramp of the inclined surface of the cathode blocks 20.

Thermal Insulation

The cell as shown in FIGS. 1 and 2 is covered with an insulating cover 65 for maintaining the electrolyte surface 33 at a sufficient temperature to inhibit formation of a crust thereon. Furthermore, the cell sidewalls 70 are lined with an insulating material, such as refractory bricks 71, preventing formation of a frozen electrolyte ledge along the cell sidewalls 70. The surface of the cell sidewalls 70 which is exposed to molten electrolyte is made of an electrolyte resistant solid material, such as silicon carbide, silicon nitrite, boron nitride, fused alumina or other metal oxides. These metal oxides, in particular iron oxide and nickel oxide, may be used for both the anodes 10 and sidewalls 70. Such metal oxides may be prevented from dissolution in the electrolyte 30 by maintaining the electrolyte 30 substantially saturated with metal species corresponding to these metal oxides.

As shown in FIGS. 1 and 3, the cell sidewalls 70 are spaced from the cathode bottom by sloping corner pieces 72 which can be made of solidified carbon-containing ramming paste resistant to molten electrolyte and molten aluminium. The corner pieces 72 may also be covered with a chemically resistant layer containing silicon carbide, silicon nitride, boron nitride or fused alumina.

As shown in FIG. 2, the insulating cover 65 is made of a plurality of sections 65*a*,65*b*,65*c*, a central fixed section 65*a* extending longitudinally along the cell above the aluminium collection groove 26 and a series of removable sections 65*b*,65*c* on each side of the cell. A first group of removable sections are inter-anode sections 65*b* located between neighbouring anodes 10. A second group of removable sections are peripheral sections 65*c* located between an upper part of sidewalls 70 and the laterally outermost anodes 10. Each pair of neighbouring anodes 10 is associated with a corresponding inter-anode section 65*b* and with an individual peripheral anode section 65*c* so arranged that when a pair of neighbouring anodes 10 needs to be extracted from or introduced into the cell only the corresponding inter-anode section 65*b* and the corresponding peripheral section 65*c* need to removed, whereby heat loss is reduced.

Furthermore, to maintain the molten electrolyte 30 at a substantially constant temperature when the insulating cover sections 65*b*,65*c* are removed, the cell can be fitted with a series of burners (not shown) located under the cell cover 65, preferably secured under the fixed section 65*a*, and operable to supply heat when neighbouring removable sections 65*b*, 65*c* are taken off.

As shown in FIGS. 1 and 2, it is preferred to leave a small gap 66 between cover sections 65*a*,65*b*,65*c* and the anode stems 14 to permit precise anode positioning of the anode structures 13,15 above the drained cathode surface 22 as well as small displacements of the anodes 10 during operation. To reduce heat loss, each gap 66 is advantageously covered with a thermally insulating flexible bellow 67 surrounding each anode stem 14 and resting on the insulating cover 65 around the gap 66.

To limit heat loss through the anode stem 14 it can be advantageous to make the anode stem above and below the insulating cover 65 of electrically highly conductive material, e.g. copper possibly provided with a mechanically reinforcing structure where exposed to high temperature, and of thermally low conductive material, such as steel, at about the location of the cell cover 65. In any case, a compromise should be made between high electrical and low thermal conductivity of the anode stem 14 so that the overall thermal and electrical energy loss is minimised.

Alumina Feeding Device

The cell, as shown in FIGS. 1 and 2, is fitted with an alumina feed device 40. The alumina feed device 40 comprises an alumina reservoir 45 whose bottom leads to a series of vertical alumina supply pipes 50. The vertical alumina supply pipes 50 extend from the alumina reservoir 45 through the fixed cover section 65*a* to below the insulating cover 65. Dosage of alumina powder 32 from the reservoir 45 to each supply pipe 50 is for example controlled as shown in FIG. 1 with a schematically-indicated vertical Archimedes screw 47 or as shown in FIG. 2 with a gate 47' which, in either case, is located at the entrance of each alumina supply pipe 50. The lower end of each alumina supply pipe 50 leads onto an alumina spreader 56 suspended thereunder, for instance by means of wires as shown in FIGS. 1 and 2, and located above the molten electrolyte surface 33. Each alumina spreader 56 is provided with a planar spreading surface form which alumina powder 32 can be sprayed.

Each alumina supply pipe 50 is also connected to a source of a hot gas 60, such as a fan or a blower, arranged to spray or blow alumina powder 32 from the alumina spreader 56 to the molten electrolyte surface 33.

As shown in FIG. 1, the hot gas source 60 is connected through a gas pipe 42 and a series of deviation pipes 43 to the alumina supply pipes 50. Each deviation pipe 43 is provided with a gas gate 41 controlling the flow of gas from the gas pipe 42 to the alumina supply pipe 50 and from there onto the alumina spreader 56. Alternatively, each alumina spreader 56 can be associated with its own source of hot gas 60 as shown in FIG. 2.

The illustrated cell is provided with two alumina spreaders 56 located on either side of the aluminium collection reservoir 27. Each alumina spreader 56 is designed to blow alumina powder 32 over one half of the cell as indicated by arrows 32' on the right-hand side of FIG. 1, and as illustrated partially on the left-hand side of FIG. 2 and on the right-hand side lower corner of the cell shown in FIG. 3.

The sprayed alumina 32 is then dissolved in the descending part of the electrolyte flow 31 as illustrated in FIG. 4 and further explained below.

Cell Operation

During operation of the above described cells, alumina dissolved in the molten electrolyte 30 is electrolysed in the inter-electrode gap between the electrochemically active surfaces 16 of anode rods 16 and the drained cathode surface 22, whereby aluminium is produced on the drained cathode surface 22 and oxygen is released on the electrochemically active surfaces 16 by oxidising oxygen-containing ions directly on the active surfaces or by firstly oxidising fluorine-containing ions that subsequently react with oxygen-containing ions, as described in PCT/IB99/01976 (Duruz/de Nora).

As shown in FIG. 4, the released oxygen generates by upward lift an electrolyte circulation 31 up to or near to the molten electrolyte surface 33 and down to the inter-electrode gap.

The electrolyte circulation 31 is generated by the escape of gas released from the active surfaces 16 of the anode rods 15 between the inter-rod gaps 17. The gas is intercepted by the upward converging surfaces 77 of the baffles 75, confining the gas and the electrolyte flow between their uppermost edges. From the uppermost edges of the baffles 75, the anodically evolved gas escapes towards the molten electrolyte surface 33, whereas the electrolyte circulation 31 flows down through the downward converging surfaces 76 to compensate the depression created by the anodically released gas below the inter-rod gaps 17. The electrolyte circulation 31 draws down into the inter-electrode gap dissolving alumina powder 32 fed into the crustless molten electrolyte 30 from above the downward converging surfaces 76 to be uniformly distributed through the active foraminate anode structure 13,15 to the inter-electrode gap.

By guiding and confining anodically-evolved oxygen towards the surface 33 of electrolyte 30 with baffles 75, in particular as shown in FIG. 4, oxygen leaves the converging surfaces 76 so close to the electrolyte surface 33 as to create turbulences fostering dissolution of alumina fed from above.

The circulating molten electrolyte 30 is maintained saturated or substantially saturated with dissolved alumina by distributing powdered alumina 32 between the molten electrolyte surface 33 and the thermal insulation 65 to the molten electrolyte surface 33, the powdered alumina 32 dissolving on entering the circulating molten electrolyte 30.

The alumina powder 32 is distributed by the spraying device 40 located above the molten electrolyte 30. Alumina powder 32 is supplied from the alumina reservoir 45 to the alumina spreader 56 by driving the Archimedes screw 47 or operating the gate 47' as shown in FIGS. 1 and 2 respectively. As shown in FIGS. 2 and 3 by arrows 32', the alumina powder 32 is sprayed over substantially the entire molten electrolyte surface 33 by blowing pressurised hot gas on the alumina spreader 56, usually hot air or possibly a flame, from the source of hot gas 60.

Dissolution in the molten electrolyte 30 of the electrochemically active anode surfaces 16 is inhibited by maintaining the molten electrolyte 30 saturated or nearly saturated with metal species corresponding to metal(s) of the active anode surfaces 16. The metal species are added to the molten electrolyte 30 together with alumina powder 32. Alternatively, the metal species may be added to the molten electrolyte 30 by dissolution of a sacrificial anode (not shown).

To avoid unacceptable contamination of the product aluminium, the temperature of the molten electrolyte 30 is maintained at a temperature sufficiently low, e.g. 730° to 910° C., preferably below 850° C., to limit the solubility of the metal species.

The produced molten aluminium is drained away from the cell sidewalls 70 which are maintained ledgeless by the presence of the thermal insulation 71 and thus remain permanently in contact the molten electrolyte 30. As shown in the right-hand upper part of FIG. 3, the produced molten aluminium is drained away from the sidewalls 70 as indicated by arrows 35, over the cathode surface 22 into the collection groove 26 and therefrom into the aluminium collection reservoir 27 as indicated by arrows 36 from where the aluminium can be intermittently or continuously tapped. By preventing contact between the product aluminium and the ledgeless sidewalls 70, erosion of the sidewalls 70 by the combined effect of produced aluminium and molten electrolyte 30 is inhibited.

Alternatives

While the invention has been described in conjunction with specific embodiments, it is evident that modifications and variations will be apparent to those skilled in the art in the light of the foregoing description. Accordingly, it is intended to embrace all such alternatives, modifications and variations which fall within the scope of the appended claims.

For instance, the cell may have more than one aluminium collection reservoir across the cell, each intersecting the aluminium collection groove to divide the drained cathode surface into four quadrants. For example, a drained cathode surface may be divided by two spaced apart aluminium collection reservoirs across the cell intersecting the aluminium collection groove along the cell. Each aluminium collection reservoir cooperates with two pairs of quadrants across the cell (one pair on each side), the central pair of quadrants between the aluminium collection reservoirs being common to both reservoirs.

Also, the deflectors 5 shown in FIGS. 1 to 6 can either be elongated baffles, or instead consist of a series of vertical chimneys of funnels of circular or polygonal cross-section.

Furthermore, the alumina spraying device may be fitted with an alumina spraying pipe extending below the insulating cover 65, along and over the molten electrolyte 30 and arranged to spray alumina powder with hot gas through a series of nozzles to the molten electrolyte surface 33.

Furthermore, the composition of the anodes can be modified so that the nickel is predominantly or wholly substituted by cobalt.

What is claimed is:

1. A cell for the electrowinning of aluminium from alumina dissolved in a fluoride-containing molten electrolyte, using anodes that are based on alloys of iron and at least one of nickel and cobalt for producing aluminium of low contamination and of commercial high grade quality, each anode having an oxygen evolving electrochemically active anode surface, the cell comprising a cathode having a drained cathode surface and operating at reduced temperature without formation of a crust or ledge of solidified electrolyte, wherein the molten electrolyte is substantially saturated with alumina, particularly on the electrochemically active anode surface, and contains dissolved species of at least one major metal that is present at the surface of the anodes and that is selected from iron, nickel and cobalt, said dissolved species being present in the molten electrolyte at or nearly at a saturation concentration so as to inhibit dissolution of the electrochemically active anode surface.

2. The cell of claim 1, wherein the molten electrolyte is NaF and $AlF_3$ based.

3. The cell of claim 2, wherein the operating temperature of the molten electrolyte is from 730° to 910° C., preferably from 750 to 880° C.

4. The cell of claim 3, wherein the operating temperature of the molten electrolyte is from 820 to 860° C.

5. The cell of claim 2, wherein the fluoride-based molten electrolyte contains 2 to 6 weight % dissolved alumina.

6. The cell of claim 2, wherein the fluoride-based molten electrolyte comprises up to 5 weight % of $MgP_2$.

7. The cell of claim 2, wherein the fluoride-based molten electrolyte comprises up to 5 weight % of LiF.

8. The cell of claim 1, comprising an aluminium-wettable cathode.

9. The cell of claim 1, comprising an aluminium collection channel along the cell for collecting produced molten aluminium draining from the drained cathode surfaces, said channel leading into a central aluminium collection reservoir across the cell from where the produced molten aluminium can be evacuated from the cell.

10. The cell of claim 9, comprising two inclined drained cathode surfaces arranged generally in a V-shape extending along the cell formed by upper surfaces of cathode blocks extending across the cell, the aluminium collection channel extending along and below bottom edges of these drained cathode surfaces, the aluminium collection reservoir being formed by recessed spacer blocks spacing the cathode blocks.

11. The cell of claim 9, wherein any undissolved alumina can deposit on and flow together with the aluminium produced from the drained cathode surfaces into the collection reservoir from where it can be recovered.

12. The cell of claim 1, comprising cell side walls contacted by the molten electrolyte, said cell side walls being made of material resistant to the molten electrolyte.

13. The cell of claim 12, wherein said cell side walls comprise a surface contacting the molten electrolyte which is made of or covered with a coating of at least one carbide and/or nitride.

14. The cell of claim 12, wherein the drained cathode surface on which aluminium is produced and from which the produced aluminium is drained comprises, or is associated with, inclined drained surfaces adjacent to said side walls, said inclined drained surfaces being inclined down towards the centre of the cell to keep the produced aluminium out of contact with said side walls.

15. The cell of claim 12, comprising a thermal insulation, including a sidewall insulation and an insulating cover above the molten electrolyte surface, for preventing the formation of any crust of solidified electrolyte or ledge of solidified electrolyte on the cell side walls, the cover being arranged to allow the removal and insertion of anodes from/into the molten electrolyte.

16. The cell of claim 15, wherein the insulating cover is of composite structure, having an inner surface layer of material resistant to fumes from the molten electrolyte, an insulating core and an outer support structure providing mechanical strength.

17. The cell of claim 15, comprising means for supplying heat between the insulating cover and the surface of the molten electrolyte to prevent formation of an electrolyte crust when the insulating cover is removed.

18. The cell of claim 17, wherein the heat-supply means comprise burners.

19. The cell of claim 15, comprising means for supplying powdered alumina between the insulating cover and the molten electrolyte surface, arranged to distribute the supplied powdered alumina over the molten electrolyte surface, from where the alumina dissolves as it enters the electrolyte to continuously maintain it saturated or substantially saturated with dissolved alumina.

20. The cell of claim 19, wherein the alumina supplying and distribution means comprises a device for spraying or blowing preheated alumina.

21. The cell of claim 1, comprising means for inducing, by upward lift of anodically produced oxygen, electrolyte circulation towards the molten electrolyte surface and down to the inter-electrode gap.

22. The cell of claim 21, wherein the means for inducing electrolyte circulation comprise electrolyte guide members with converging surfaces, arranged above a foraminate anode of open structure comprising a series of vertical through openings for the rapid escape of anodically produced oxygen and for the don flow of alumina-rich electrolyte into the anode-cathode gap for electrolysis.

23. The cell of claim 22, wherein the foraminate anode structure comprises a series of spaced apart parallel anode rods each having an electrochemically active surface, at least one connecting cross-member extending transversally over the anode rods to mechanically and electrically connect the anode rods, and an anode current supply stem secured to the cross-member(s).

24. The cell of claim 23, wherein the connecting cross-member has a section such that current can be fed to the anode rods at a substantially uniform current density.

25. The cell of claim 1, comprising means to adjust the positioning of the anodes over the drained cathode surface.

26. The cell of claim 25, wherein each anode is suspended from a superstructure which comprises one or more motors arranged to displace the anode linearly and/or angularly.

27. The cell of claim 25, wherein each anode is spaced from the drained cathode surface by spacer elements which are resistant to the product aluminium, the molten electrolyte and the anodically produced oxygen.

28. The cell of claim 1, wherein each anode is associated with means to oscillate it around at least one axis to enhance distribution of dissolved alumina in the inter-electrode gap.

29. The cell of claim 28, wherein said at least one axis of oscillation is substantially vertical to the drained cathode surface.

30. The cell of claim 1, wherein each anode comprises a foraminate active anode structure comprising openings for the rapid escape of anodically produced oxygen gas towards the surface of the molten electrolyte.

31. The cell of claim 1, wherein each iron-based alloy has an openly porous outer portion which consists predominantly of nickel and/or cobalt metal whose surface constitutes in use is an electrochemically active anode surface of high surface area.

32. The cell of claim 1, wherein each electrochemically active anode surface comprises at least one of iron, nickel and cobalt as metal(s) and/or oxide(s).

33. The cell of claim 32, wherein each electrochemically active anode surface comprises a ferrite of nickel or cobalt.

34. The cell of claim 32, wherein each electrochemically active anode surface is an outer surface of an integral oxide based outer layer.

35. A method of electrowinning aluminium in a cell for the electrowinning of aluminium from alumina dissolved in a fluoride-based molten electrolyte as defined in claim 1, the method comprising supplying alumina to the molten electrolyte where it is dissolved to maintain the electrolyte substantially saturated with alumina, particularly on the electrochemically active anode surface, and electrolysing the dissolved alumina in the inter-electrode gap to produce oxygen gas on the anodes and aluminium on the drained cathodes.

36. A method as defined in claim 35, in which the electrolyte contains $AlF_3$ in such a high concentration that fluorine-containing ions rather than oxygen ions are oxidised on electrochemically active anodes surfaces that are catalytically active for the oxidation of fluorine-containing ions rather than oxygen ions, however only oxygen is evolved, the evolved oxygen being derived from the dissolved alumina present near the electrochemically active anode surfaces.

37. A cell for the electrowinning of aluminium from alumina dissolved in a fluoride-containing molten electrolyte, using anodes that are based on alloys of iron and at least one of nickel and cobalt to produce aluminium of low contamination and of commercial high-grade purity, the cell comprising in combination:

(a) a plurality of anodes that: are based on alloys of iron and at least one of nickel and cobalt immersed in the molten electrolyte, each anode having an oxygen-evolving electrochemically active surface spaced by an inter-electrode gap from an aluminium-wettable drained cathode surface;

(b) means for inducing, by upward lift of oxygen released from the anodes, circulation of the electrolyte towards the molten electrolyte surface and down to the inter-electrode gap;

(c) cell side walls contacted by the molten electrolyte, the cell side walls being made of material resistant to the molten electrolyte;

(d) a thermal insulation, including a sidewall insulation and an insulating cover above the molten electrolyte surface, for preventing the formation of any crust of solidified electrolyte or ledge of solidified electrolyte on the cell side walls, the cover being arranged to allow the removal and insertion of anodes from/into the molten electrolyte;

(e) means for supplying powdered alumina between the insulating cover and the molten electrolyte surface, arranged to distribute the supplied powdered alumina over the molten electrolyte surface, from where the alumina dissolves as it enters the electrolyte to continuously maintain it substantially saturated with alumina;

(f) the aluminium-wettable drained cathode surface on which aluminium is produced and from which the produced aluminium is drained comprising, or being associated with, inclined drained surfaces adjacent to the side walls, said inclined drained surfaces being inclined down towards the centre of the cell to keep the produced aluminium out of contact from the side walls; and (g) a central aluminium collection reservoir for collecting molten aluminium draining from the drained cathode surfaces and/or from said inclined drained surfaces from where the produced aluminium can be evacuated from the cell; and wherein (h) the molten electrolyte is substantially saturated with alumina, particularly on the electrochemically active anode surf ace, and contains dissolved species of at least one major metal present at the surface of the anodes, which inhibits dissolution of the anodes, and results in a concentration of the metal species in the produced molten aluminium within commercially acceptable limits, said dissolved species being selected from species of iron, nickel and cobalt and being present in the molten electrolyte at or nearly at a saturation concentration so as to inhibit dissolution of the electrochemically active anode surface.

38. A method of electrowinning aluminium in a cell for the electrowinning of aluminium from alumina dissolved in a fluoride-containing molten electrolyte as defined in claim 36, the method comprising:

(a) electrolysing in the inter-electrode gap the alumina dissolved in the molten electrolyte, thereby producing aluminium on the drained cathode surface and releasing oxygen on the anodes that are based on alloys of iron and at least one of nickel and cobalt, the released oxygen generating by upward lift an electrolyte circulation towards the surface of the molten electrolyte and down to the inter-electrode gap;

(b) maintaining the circulating molten electrolyte substantially saturated with dissolved alumina, particularly on the electrochemically active anode surface, by distributing powdered alumina between the surface of the molten electrolyte and the thermal insulation to the surface of the molten electrolyte which is maintained crust less by the presence of the thermal insulation, the powdered alumina dissolving on entering the circulating molten electrolyte;

(c) inhibiting dissolution in the molten electrolyte of the anode surfaces by maintaining the molten electrolyte substantially saturated with dissolved metal species of at least one major metal that is present at the surface of the anodes and that is selected front iron, nickel and cobalt;

(d) maintaining the molten electrolyte at a temperature sufficiently low to limit the solubility of said metal species therein, thereby limiting the contamination of the product aluminium to an acceptable level;

(e) draining the produced molten aluminium from the cathode surface to the centre of the cell into the collection reservoir away from the cell sidewalls which are maintained ledgeless by the presence of the thermal insulation and contact the molten electrolyte; and (g) evacuating from the central aluminium collection recess the produced molten aluminium.

* * * * *